US005994021A

United States Patent [19]

Katoh et al.

[11] Patent Number: 5,994,021

[45] Date of Patent: Nov. 30, 1999

[54] THERMOGRAPHIC MATERIAL AND RECORDING METHOD

[75] Inventors: Eisaku Katoh; Shuji Kida; Osamu Hatano; Kenzo Nakazawa, all of Hino, Japan

[73] Assignee: Konica Corporation, Japan

[21] Appl. No.: 08/864,131

[22] Filed: May 28, 1997

[30] Foreign Application Priority Data

Jun. 13, 1996 [JP] Japan ..... 8-152209

[51] Int. Cl.[6] ..... G03C 1/498

[52] U.S. Cl. ..... 430/138; 503/205; 503/214; 430/337; 430/338

[58] Field of Search ..... 430/138, 337, 430/338, 339; 503/205, 214

[56] References Cited

U.S. PATENT DOCUMENTS

| | | | |
|---|---|---|---|
| 3,951,658 | 4/1976 | Marsh et al. | 430/138 |
| 4,416,966 | 11/1983 | Sanders et al. | 430/138 |
| 4,665,410 | 5/1987 | Iiyama et al. | 346/204 |
| 4,956,254 | 9/1990 | Washizu et al. | 430/138 |
| 4,996,537 | 2/1991 | Kishimi | 430/348 |
| 5,185,233 | 2/1993 | Santo | 430/945 |

FOREIGN PATENT DOCUMENTS

| | | | |
|---|---|---|---|
| 54-61541 | 5/1979 | Japan | 503/205 |
| 2160992 | 1/1986 | United Kingdom . | |

OTHER PUBLICATIONS

European Search Report EP 97 30 4081 with Annex.

Patent Abstracts of Japan Pub. #01129247—Abstract only.

Patent Abstracts of Japan Pub. #02190386—Abstract only.

Patent Abstracts of Japan Pub. #03001983—Abstract only.

*Primary Examiner*—Martin Angebranndt

*Attorney, Agent, or Firm*—Jordan B. Bierman; Bierman, Muserlian and Lucas

[57] ABSTRACT

A thermographic material is disclosed which comprises a support and provided thereon, a recording layer containing a photolytic free radical generating agent capable of providing a free radical on absorption of light, a dye decolored by the free radical, and an anti-decolorizing agent, the photolytic free radical generating agent and dye being contained in a microcapsule in the recording layer, and the anti-decolorizing agent being present outside the microcapsule in the recording layer, wherein an image is formed by imagewise heating the thermographic material to mix the anti-decolorizing agent with the photolytic free radical generating agent and the dye to form a latent image, and then exposing the heated material to light which the photolytic free radical generating agent absorbs, so that the dye at the latent image portions is not decolored and the dye at portions other than the latent image portions is decolored.

13 Claims, No Drawings

THERMOGRAPHIC MATERIAL AND RECORDING METHOD

FIELD OF THE INVENTION

The present invention relates to a thermographic material and a recording method in which portions which have not been heated are exposed to light to be decolored.

BACKGROUND OF THE INVENTION

A thermographic material (hereinafter referred to also as a recording material) for forming an image using a thermal head has advantages such as simplicity of a recording apparatus, no developing process, no noise, maintenance-free and low cost, and is applied in various fields such as printers and facsimile devices.

A conventional thermographic material has the advantages described above, but has problems that undesirable coloring occurs on accidental heating after recording, since only heating causes coloring reaction and that recording is easy to corrupt and low in reliability. Therefore, a thermographic material capable of fixing a formed image has been eagerly sought.

As a typical thermographic material capable of fixing a formed image, a diazo thermographic material is well known, but the diazo thermographic material has the problem that a diazonium compound used is likely to give a background fog due to its high reactivity and results in such a background fog as maximum color density after long-term storage due to poor thermal stability.

Recently, background fog has been reduced by separating the diazonium compound from a coupler using a microcapsule, but the reduction is not still satisfactory, and a more stable thermographic material has been sought.

In Japanese Patent O.P.I. Publication Nos. 1-129247, 1-143252, 3-19252 and 3-1983 is disclosed a thermographic material comprising a microcapsule, in which a photolytic free radical generating agent and a leuco dye are incorporated, with a reducing agent present outside the microcapsule. In this thermographic material, it is possible to mix the reducing agent with the photolytic free radical generating agent and leuco dye by applying heat not to form a dye from the leuco dye, and to entirely expose the heated material to form a dye at portions which have been not heated. However, this type of thermographic material, containing an oxidation developing leuco dye forming a dye on reaction with a photolytic free radical generating agent, has the problems that fog occurs, since the material is subjected to room light or sun light during storage or the photolytic free radical generating agent is gradually decomposed during long term storage. A more stable thermographic material easy to handle has been sought.

The above thermographic material is not colored at heated portions and colored at non-heated portions. This is a thermographic material giving a reversed image different from a conventional thermographic material, and therefore, the usage is limited.

In Japanese Patent Publication No. 43-29407 is disclosed a method of decoloring a dye by imagewise exposure to form an image, but this method has so far not been applied to thermographic materials.

In Japanese Patent O.P.I. Publication Nos. 2-190386, 2-190385 and 2-190383 is disclosed a thermographic material containing an organic boron compound salt of a cationic dye such as a cyanine dye or a xanthene dye, wherein the material is exposed to light which the salt absorbs to decolor the dye and form an image. In this material, a recording image is obtained by mixing, at heated portions, a compound decomposing an organic boron compound with the organic boron compound, whereby the organic boron compound is decomposed to a compound which does not decolor by light exposure, and then by exposing to light to decolor non-heated portions.

However, this thermographic material has various problems, since dyes used or light wavelength used for decoloring the dyes are limited. Such cationic dyes have the problems in that the formed image is poor in stability or light fastness. The cationic dyes are easily decolored by room light, and therefore, there is a problem that a thermographic material using such dyes are difficult to handle under room light. It is necessary to mix a compound decomposing an organic boron compound with the organic boron compound by heating and then decompose the organic boron compound, however, instantaneous heating due to a thermal head is difficult to completely decompose the organic boron compound. Further, such dyes used, which are generally salts, are low in organic solvent solubility and expensive.

SUMMARY OF THE INVENTION

An object of the invention is to solve the above described problems and to provide a thermographic material with excellent storage stability, which can handle under room light, which can provide a high quality image formed by heating with a thermal head and simple light exposure and which can provide a fixed image difficult to corrupt, and to provide a recording method using the material.

DETAILED DESCRIPTION OF THE INVENTION

The above object of the invention can be attained by the following constitution:

1. a thermographic material comprising a support and provided thereon, a recording layer containing a photolytic free radical generating agent capable of providing a free radical on absorption of light, a dye decolored by the free radical and an anti-decolorizing agent, the photolytic free radical generating agent and the dye being contained in a microcapsule in the recording layer and the anti-decolorizing agent being present outside the microcapsule in the recording layer, wherein the thermographic material is imagewise heated to mix the anti-decolorizing agent with the photolytic free radical generating agent and the dye to form a latent image, and exposed to light, which the photolytic free radical generating agent absorbs, so that the dye at the latent image portions is not decolored and the dye at portions other than the latent image portions is decolored, whereby an image is formed, or 2. a recording method of forming an image, the method comprising the steps of:

imagewise heating a thermographic material, which comprises a support and provided thereon, a recording layer containing a photolytic free radical generating agent capable of providing a free radical on absorption of light, a dye decolored by the free radical and an anti-decolorizing agent, the photolytic free radical generating agent and the dye being contained in a microcapsule in the recording layer and the anti-decolorizing agent being present outside the microcapsule in the recording layer, to mix the anti-decolorizing agent with the photolytic free radical generating agent and the dye to form a latent image; and exposing the heated thermographic material to light, which the photolytic free radical generating agent absorbs, so that the dye at the latent image portions is not decolored and the dye at portions other than the latent image portions is decolored.

The thermographic material of the invention comprises both photolytic free radical generating agent and dye contained in the same microcapsules, and is exposed to light, which the photolytic free radical generating agent absorbs, to decolor the dye.

On the other hand, the anti-decolorizing agent inhibiting decoloration due to the photolytic free radical generating agent is present outside the microcapsules, and at heated portions where the capsules show heat penetration, the anti-decolorizing agent outside the capsules is mixed with the free-radical generating agent and the dye both within the capsules. Decolorization of the dye is prevented by light exposure at the portions mixed with the anti-decolorizing agent, whereby an image is formed.

In the thermographic material of the invention, once an image is formed, that is, once the material is heated, followed by light exposure, so that decolorization is inhibited at heated portions and decolorization occurs at non-heated portions, decoloration no longer occurs at colored portions or recoloration no longer occurs at decolored portions by further heating or further exposure. Therefore, a fixed image is obtained.

A conventional thermographic material, in which an image is formed by color development, is likely to produce stains at background portions, when, during long term storage, components for color development contact one another, for example, a color developer contacts a leuco dye or a diazonium salt contacts a coupler. On the contrary, in the thermographic material of the invention, the photolytic free radical generating agent, in an amount larger than the necessary amount, makes it possible to easily avoid occurrence of the stains at background portions, even if during long term storage the anti-decolorizing agent outside the microcapsules is mixed with the dye and photolytic free radical generating agent inside the microcapsules.

Since a dye and a photolytic free radical generating agent are independently present in the invention, unlike the thermographic material disclosed in Japanese Patent O.P.I. Publication Nos. 2-190386, 2-190385 and 2-190383 containing an organic boron compound salt of a cationic dye and a compound cleaving a carbon-boron bond, the compounds used in the invention can be selected from a broad range of compounds. Since dyes, which are decolored by a free radical produced from a photolytic free radical generating agent, form an image by themselves at heated portions to be printed, the dyes are required to have high light fastness and high heat resistance and further, the dyes preferably have a large molar extinction coefficient to obtain a high recording image density. The molar extinction coefficient of the dyes is preferably 10,000 or more. The color tone of a recording image is an important criterion on selection of the dyes used. A photolytic free radical generating agent for decoloring a dye can be selected independently of the dye.

The photolytic free radical generating agent is exposed to light which it absorbs, and thereby produces a free radical. The photolytic free radical generating agent can be selected according to wavelength of light for exposure. Regarding light for exposure, ultraviolet or infrared light can be used to prevent deterioration of thermographic material under room light.

In the invention, a mixture of a dye and a photolytic free radical generating agent is exposed to light to decolor the dye, but the decolorization mechanism is not clear.

The present inventors have found that when the mixture of a dye and a photo free radical generating agent is further mixed with an anti-decolorizing agent and the resulting mixture is exposed to light which the photolytic free radical generating agent absorbs, no decolorization occurs, and have attained the invention. When a mixture of a dye and a photolytic free radical generating agent is further mixed with an anti-decolorizing agent while heating to form a latent image, the mixing does not cause any reaction. However, when the mixture of the three is exposed to light which the photolytic free radical generating agent absorbs, decomposition reaction of the photolytic free radical generating agent proceeds, but decolorization of the dye is inhibited. The dyes at portions other than those forming a latent image are decolored by exposure of light which the photolytic free radical generating agent absorbs. Accordingly, when the thermographic material of the invention is printed by heating and being exposed to light, the dyes at non-heated portions are decolored and the dyes at heated portions are not decolored so that a fixed image is obtained.

The invention will be detailed below.

A dye and photolytic free radical generating agent in the invention are the photolytic free radical generating agent and a dye capable of being decolored by exposure of light which the photolytic free radical generating agent absorbs, that is, a dye capable of being converted to a compound which does not absorb a visible light wavelength region. The dye includes an azo dye, an azomethine dye, a polyene dye, a polymethine dye, a quinone dye, an indigo dye, a diphenylmethane dye, a triphenylmethane dye, and a phthalocyanine dye. More concretely, the dyes described in Kodansha, "Sikiso Handbook", edited by Nihon Shikizai Kyokai are cited.

The dyes used in the invention can be selected from these in view of color tone, photo decolorizing property, image fastness or cost. The dyes are contained in the microcapsules with the photolytic free radical generating agent, but an ionic compound is difficult to be incorporated in the microcapsules. Particularly when emulsified oil drops are capsuled by interfacial polymerization, it is necessary to emulsify the wall material and a core substance to be capsuled, however, when the core substance is ionic, emulsification is not completely carried out. The core substance comes out on the surface of the microcapsules and the capsulation is not completed.

The dyes used in the invention are preferably neutral dyes having no ionic charge. Of the neutral dyes, an azomethine dye is more preferable. The azomethine dye used in a conventional color photographic is especially preferable in view of color tone or dye fastness, exemplarily, an azomethine dye produced by oxidation coupling reaction of a coupler such as an acylacetoanilide derivative, a pyrazolone derivative, a pyrazolotriazole derivative, a phenol derivative or a naphthol derivative with a color developing agent (such as a p-diphenylenediamine derivative). The preferable dyes are listed below, but are not limited thereto.

Exemplified Dye
Dye A-1
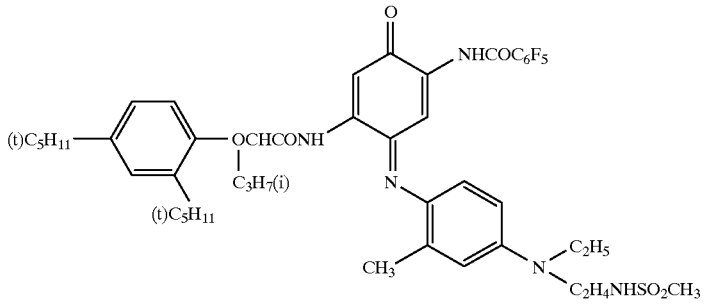
Dye A-2
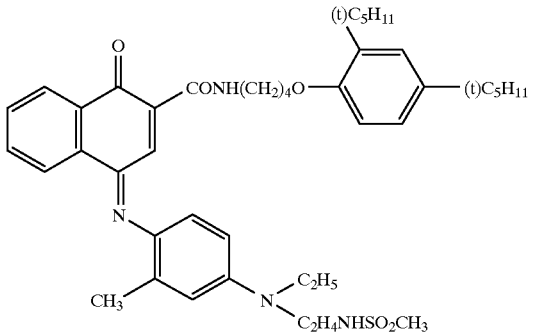
Dye A-3
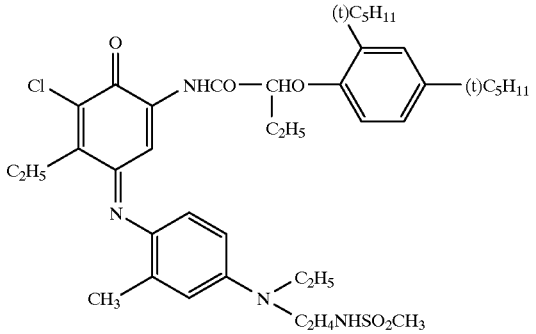
Dye A-4
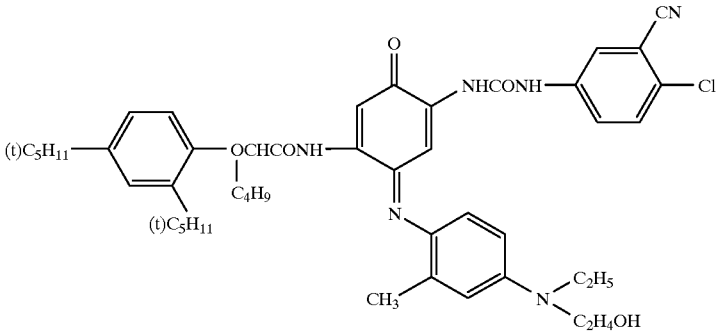

-continued
Dye A-5
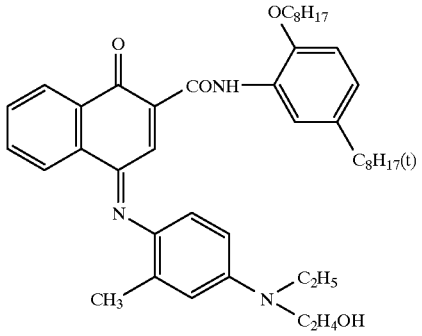
Dye B-1
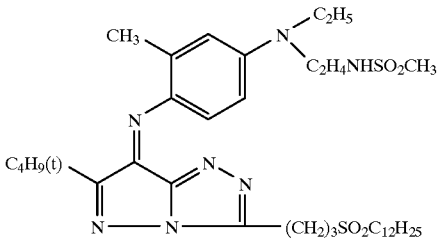
Dye B-2
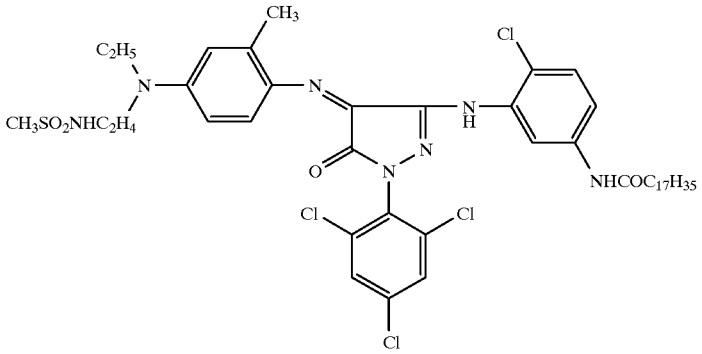
Dye B-3
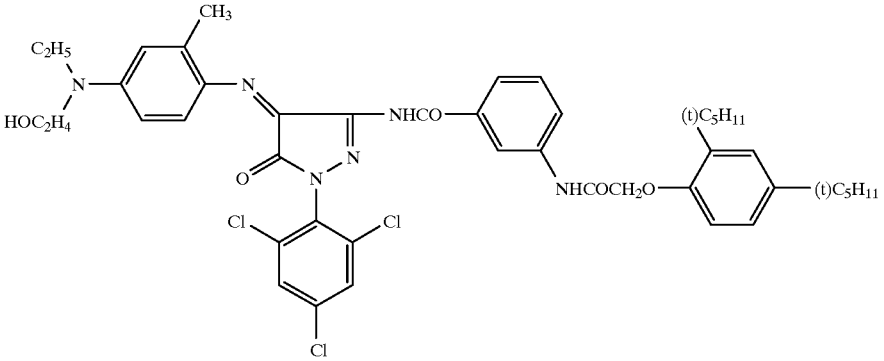

-continued
Dye B-4
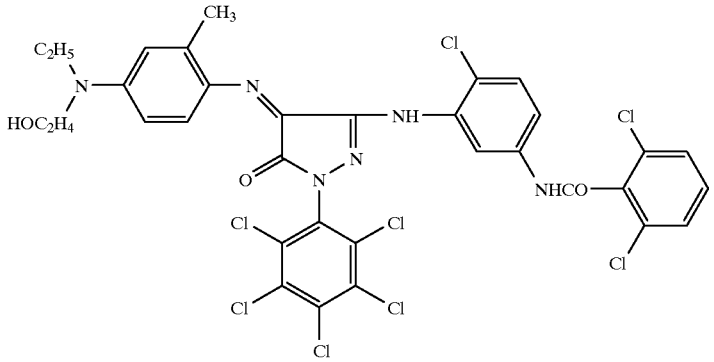
Dye C-1
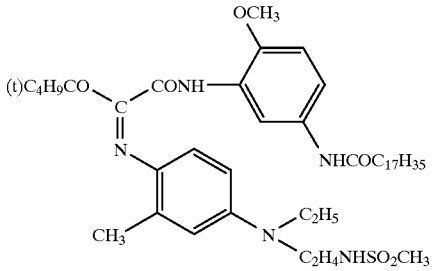
Dye C-2
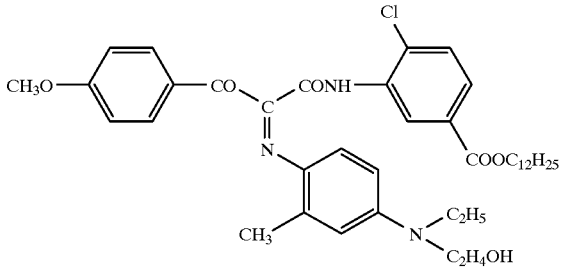
Dye C-3
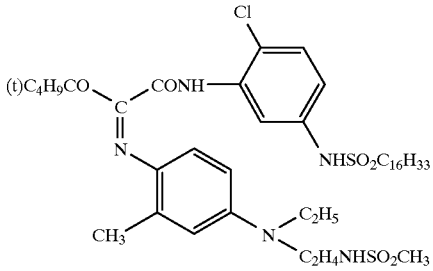
Dye C-4
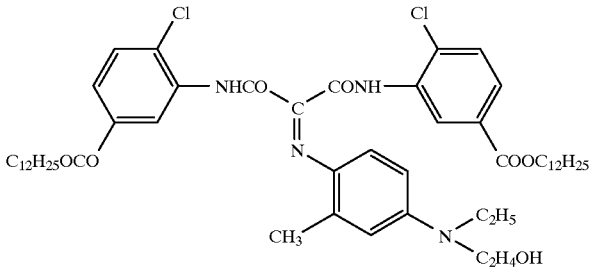

-continued

Dye D-1

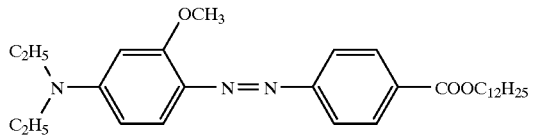

Dye D-2

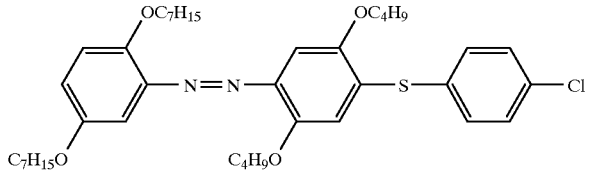

Dye D-3

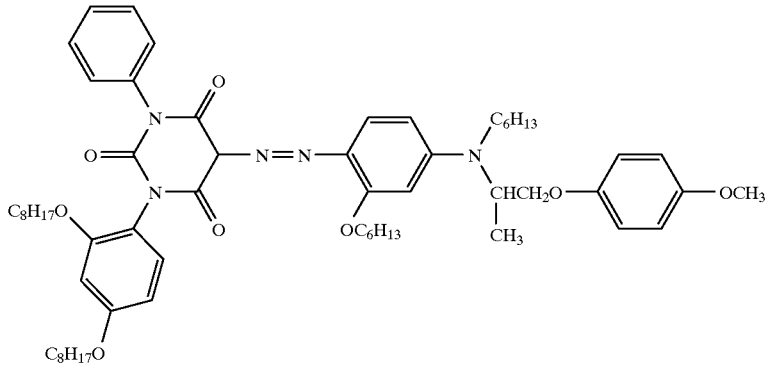

The photolytic free-radical generating agent means an agent which decolors a dye on its absorption of light having a specific wavelength. The agent includes a carbonyl compound, a diazonium compound and an azide compound. The photolytic free radical generating agent includes an agent which decomposes to produce a free radical on light absorption and such an agent that, when the agent activated by light absorption abstracts hydrogen from another compound, the activated agent or the hydrogen abstracted compound forms a radical. The light absorbed for radical formation may be light which is absorbed by a sensitizing dye as a sensitizer. The sensitizing dye is preferably a dye having no absorption in the visible light wavelength range, which has no adverse effect on an image.

The photolytic free radical generating agent includes a dimer of 2,4,6-triarylimidazole disclosed in Japanese Patent Publication Nos. 62-39728 and 63-2099, an azide compound such as 2-azidobenzoxadiazole, benzoylazide, or 2-azidobenzimidazole disclosed in U.S. Pat. No. 3,282,693, a pyridinium compound such as 3'-ethyl-1-methoxy-2-pyridothiacyanine perchlorate or 1-methoxy-2-methylpyridinium-p-toluenesulfonate disclosed in U.S. Pat. No. 3,615,568, an organic halogen compound such as N-bromosuccinimide, tribromomethylphenylsulfone, iodine diphenyl, 2-trichloromethyl-5-(p-butoxystyryl)-1,3,4-oxadiazole or 2,6-bis(trichloromethyl)-4-(p-methoxyphenyl)-s-triazine, a carbonyl compound such as benzophenone, thioxanthone, anthraquinone or benzoin ether, an azo compound such as azobisisobutyronitrile and an organic sulfur compound such as an alkyldisulfide or mercaptan.

The light wavelength for activating the photolytic free radical generating agent can be selected in view of workability of thermographic material, or availability or cost of a light source. There is a limitation that a thermographic material sensitive to room light has problem in stability and must be handled under dark room. In order to remove such a limitation, ultra-violet light to a part of visible light or infrared light is preferably used. Of these, a light of 250 to 450 nm is more preferably used in view of availability of a light source.

The preferable photolytic free radical generating agent includes a carbonyl compound such as anthraquinone or benzoin ether and a diazonium compound. The absorption maximum of the photolytic free radical generating agent is present in the wavelength range of preferably 250 to 450 nm in view of free radical generating efficiency. The exemplified photolytic free radical generating agents are listed below, but are not limited thereto.

Exemplified Photolytic Free Radical Generating Agent

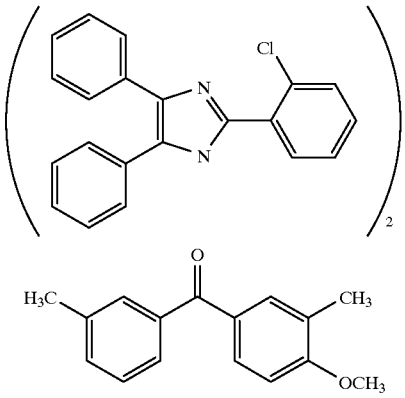

-continued

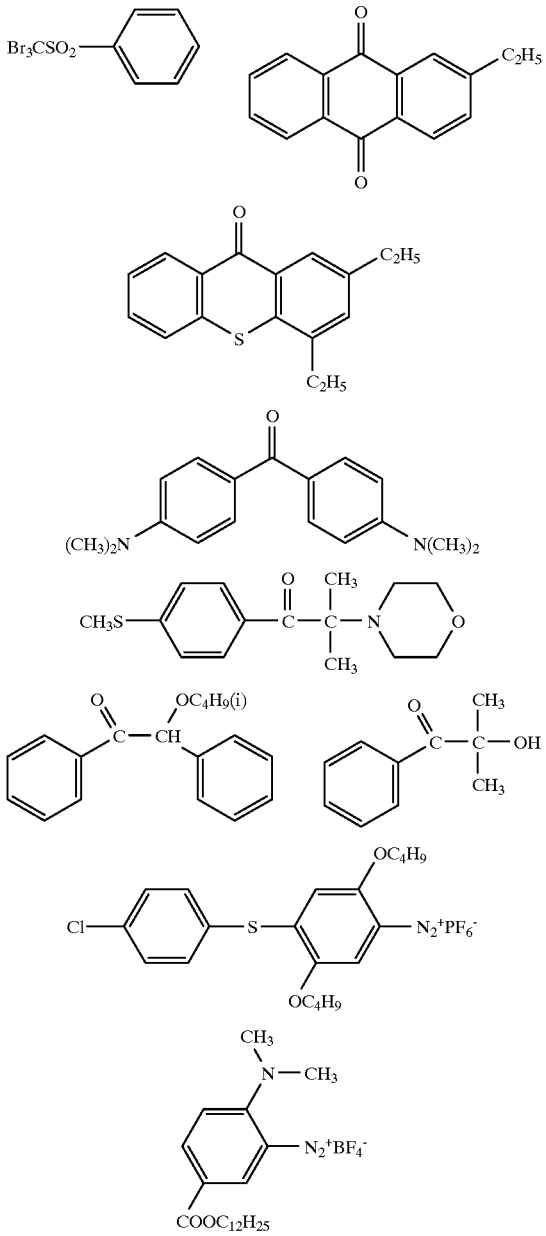

In the invention, the anti-decolorizing agent is an agent which inhibits reaction of a photo free radical generating agent with a dye and prevents decolorization of the dye. The decolorization mechanism is not clear, but there is considered mechanism that the anti-decolorizing agent traps a free radical produced on activation of the photo free radical generating agent or re-colors a reaction product of the dye with the photo free radical generating agent. The mechanism may be different depending on a combination of the photo free radical generating agent and the anti-decolorizing agent.

The anti-decolorizing agent in the invention includes guanidines such as triphenylguanidine, tetramethylguanidine, and dicyclohexylguanidine, amines such as bis(2-ethylhexyl)-aminetrioctylamine, diisopropylethylamine, N,N-dimethyl-o-dodecylamine, piperazine, pyrrolidine and hyndered amines, hydroquinone derivatives such 2,5-di-tert-octylhydroquinone and 2,5-di-sec-dodecylhydroquinone, mercaptans such as p-dodecyloxythiophenol, 2-mercaptobenzimidazole, and 2-mercaptobenzothiazole, phenols such as 2,6-di-tert-butylphenol, 4,4'-butylidenebis(6-tert-butyl-m-cresol) and hyndered phenols, and a reducing agent such as hydrazine, phenidone or ascorbic acid, but is not limited thereto.

The preferable anti-decolorizing agent is guanidines or amines. The preferable exemplified anti-decolorizing agent is listed below, but is not limited thereto.

Exemplified anti-decolorizing agent

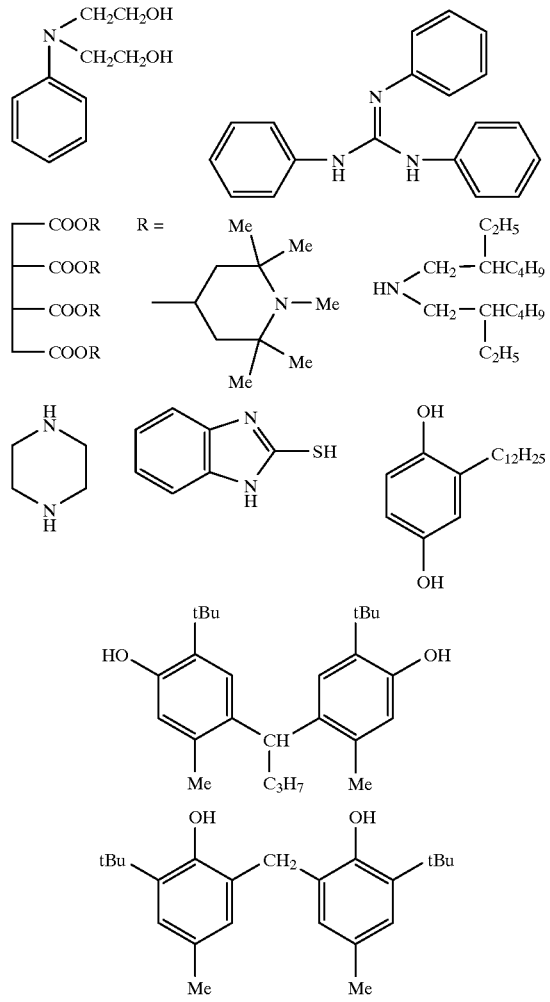

In the thermographic material of the invention, the dye and photolytic free radical generating agent are both incorporated in microcapsules, and separated from the anti-decolorizing agent before application of heat. When the material is heated by a thermal head, the above three agents are quickly mixed to form a latent image, and thereafter, light exposure causes decolorization reaction at non-heated portions. In the microcapsules used in the invention, the walls of the microcapsules prevent a substance within the microcapsules from contacting a substance outside the microcapsules at an ordinary temperature and when the microcapsule walls are heated to at least the glass transition temperature (60° C. or more, and preferably 80° C. or more) of materials constituting the walls, penetration of the substances through the walls takes place.

In the thermographic material of the invention, the dye and photolytic free radical generating agent are both incorporated in microcapsules, and the anti-decolorizing agent is present outside the microcapsules. If an image could be formed simply by controlling mixing and separation of substances used, there could be used a thermographic material comprising an anti-decolorizing agent incorporated in microcapsules and comprising a dye and photolytic free radical generating agent both present outside the microcapsules. However, oxygen in air has an adverse effect on decolorization of a dye due to a free radical. For example, decolorizing speed is low or decolorizing portions re-color under high oxygen concentration, however, the thermographic material of the invention which comprises a dye and photolytic free radical generating agent both incorporated in microcapsules and an anti-decolorizing agent present outside the microcapsules, can minimize such an adverse effect of oxygen. Further, when the dye is incorporated in microcapsules, contact of the dye with oxygen is prevented and therefore, the formed image has high fastness.

As a method of separating a dye from a photolytic free radical generating agent, besides the microcapsule method, there is a method of providing a layer containing a dye and a photolytic free radical generating agent, and a layer containing an anti- anti-decolorizing agent in separate two layers. However, this method has a problem in that the two layers contact each other and mixing of the layers is unavoidable, and that, even if an intermediate layer is provided between the two layers in order to avoid such mixing, heat sensitivity is threby lowered.

The penetration through the microcapsule walls can be controlled by changing the glass transition temperature of the microcapsule walls according to the kind of microcapsule wall material, the core composition in the microcapsule or the kind of additives.

The wall material of the microcapsule used in the invention includes polyurethane, polyurea, polyamide, polyester, polyether, polycarbonate, a urea-formaldehyde resin, a melamine-formaldehyde resin, polystyrene, a styrene-methacrylate copolymer, gelatin, polyvinyl pyrrolidone and polyvinyl alcohol. The wall materials may be used in combination. Of these materials, polyurethane, polyurea, polyamide, polyester or polycarbonate is preferable, and polyurethane or polyurea is more preferable. The microcapsule used in the invention is detailed in U.S. Pat. No. 3,796,696.

The microcapsules are prepared by emulsifying a core composition containing substances to be incorporated in the capsules to form oil drops and then forming polymer walls around the oil drops. The polymer walls is preferably formed by interfacial polymerization. In order to form emulsified oil drops, an organic solvent is preferably used as necessary. The organic solvent used includes a high boiling point organic solvent. The high boiling point organic solvent includes phosphates, phthalates, acrylates, methacrylates or other esters, fatty acid amides, alkylated biphenyls, alkylated terphenyls, chlorinated paraffin, alkylated naphthalenes, diarylethanes. Those disclosed in Japanese Patent O.P.I. Publication Nos. 60-242094 and 62-75409 can be used.

Besides the above described high boiling point organic solvent, a low boiling point organic solvent such as ethyl acetate or methylene chloride can be used in combination as an auxiliary solvent. A water soluble polymer such as polyvinyl alcohol, gelatin or a cellulose derivative can be used as a protective colloid in an aqueous phase mixed with an oil phase.

When emulsification is carried out, an appropriate surfactant can be used not to produce precipitation or aggregation.

The microcapsule has a size of preferably 0.1 to 20 $\mu$m, and more preferably 0.5 to 10 $\mu$m.

The anti-colorizing agent outside the microcapsules may be solid dispersed or emulsified, and is preferably emulsified. In the solid dispersed or emulsion of the anti-colorizing agent, the anti-colorizing agent has a particle size of preferably 0.1 to 20 $\mu$m, and more preferably 0.5 to 10 $\mu$m in view of image quality or density.

The content of the dye, photolytic free radical generating agent or anti-colorizing agent in the thermographic material of the invention is not specifically limited, and determined depending on the thickness of a layer containing the dye, photo free radical generating agent and anti-colorizing agent, anti-colorizing efficiency or image density. The content of the dye, photo free radical generating agent or anti-colorizing agent in the thermographic material is preferably $5\times10^{-5}$ to $2\times10^{-2}$ mol/liter. The layer thickness is not specifically limited, and the dry thickness is preferably 0.5 to 50 $\mu$m, and more preferably 1 to 20 $\mu$m.

The thermographic material of the invention can be prepared by coating, on a support, an anti-colorizing agent and microcapsules containing a dye and a photolytic free radical generating agent. The binder used in the above described dispersion includes polyvinyl alcohol, gelatin, styrene-butadiene latex, carboxymethyl cellulose, gum arabic, polyvinyl pyrrolidone, and an emulsion of polyvinyl acetate or polyacrylates. The binder is used in an amount of preferably 0.2 to 5 g/m$^2$ in terms of solid.

In the thermographic material of the invention, a protective layer can be provided in order to protect an image, to prevent adhesion of the material with one another or with a thermal head, or to improve writing ability or the surface smoothness. The binder in the protective layer includes a conventional binder such as methyl cellulose, carboxymethyl cellulose, hydroxymethyl cellulose, starch, gelatin, gum arabic, casein, styrene-maleic anhydride copolymer hydrolysate, polyvinyl alcohol, carboxy-modified polyvinyl alcohol, polyacrylamide derivatives, polyvinyl pyrrolidone, polystyrene sulfonic acid, sodium alginate, styrene-butadiene latex, acrylonitrile-butadiene rubber latex, polyvinyl acetate emulsion, a silicone resin, a melamine resin, a phenol resin, an acryl resin, a polyester resin, an epoxy resin, a fluorine-containing resin, nitrocellulose, cellulose acetate propionate, cellulose acetate, a fluorinated vinylidene resin and chlorinated rubber. Fillers in the protective layers include inorganic pigment such as zinc oxide, calcium carbonate, barium sulfate, titan oxide, lithopone, talc, agalmatolite, kaolin, aluminum oxide, non-crystal silica, colloidal silica, organic pigment such as polystyrene, polymethylmethacrylate, polyethylene, a vinyl acetate resin, a vinyl sulfide resin, a vinylidene sulfide resin, a styrene-methacrylate copolymer, polyvinylidene chloride, polyurea, or a melamine-formaldehyde resin, a metal soap such as zinc stearate, calcium stearate or aluminum stearate, wax such as paraffin wax, microcrystalline wax, carnauba wax, methylolstearylamide, polyethylene wax or silicone wax. These fillers may be used singly or in combination.

The thermographic material can be prepared by coating a coating solution on a support such as paper or a synthetic resin film by a conventional coating method. The coating method includes a dip-coating method, a air-knife-coating method, a curtain-coating method, a roller-coating method, a doctor-coating method, a wire-bar-coating method, a slide-coating method, a gravure-coating method, a spin-coating method and an extrusion-coating method.

The support in the thermographic material includes a film such as paper, reproduced cellulose, cellulose nitrate, polyethylene terephthalate, polyethylene, polyvinyl acetate or polyethylene naphthalate, glass, tree and metal.

The thermographic material is heated and entirely exposed to form an image. The heat source used for heating includes a thermal pen, a thermal head, a thermal stamp, and near-infrared light, and is not specifically limited, as long as heat energy necessary to change penetration of the microcapsules can be imagewise given to the thermographic material.

The light source used for exposure may be any light source, as long as it can decompose a photolytic free radical generating agent to produce a free radical. The light source includes a fluorescent lamp, a high-pressure mercury lamp, a xenon lamp, a tungsten lamp and a sun light.

EXAMPLES

The invention will be explained by the following examples to which the embodiments of the invention are not limited. In the examples, "parts" is parts by weight, unless otherwise specified.

Example 1

(Preparation of Capsule Solution A)

Dye A-1 (molar extinction coefficient: about 18,000) of 1.5 parts and 1.5 parts of benzoin isobutyl (absorption maximum wavelength in an ethyl acetate solution: 327 nm) were dissolved in a mixture solvent of 10 parts of ethyl acetate and 10 parts of 1-phenyl-1-xylylethane, and 8.0 parts of xylylenediisocyanate-trimethylolpropane adduct and 0.5 parts of a 10% aqueous sodium dodecylbenzene sulfonate solution were added. The resulting solution was incorporated into 60 parts of a 6% aqueous polyvinyl alcohol solution and emulsified at 20° C. using a homogenizer to obtain an emulsion containing emulsified particles having an average particle size of 1 μm. To the emulsion 20 parts of water were added, stirred at 40° C. for 3 hours, and cooled to room temperature. Thus, Capsule Solution A was obtained.

(Preparation of Anti-decolorizing Agent Solid Dispersion)

Thirty parts of triphenylquanidine were incorporated into 150 parts of a 4% aqueous polyvinyl alcohol solution and dispersed at 20° C. using a sand mill to obtain a triphenylquanidine dispersion containing solid dispersion particles having an average particle size of 1 μm.

(Preparation of Coating Solution)

The Capsule Solution A and Anti-decolorizing Agent Solid Dispersion prepared above were mixed in a weight ratio of 5:4 to obtain a coating solution.

The resulting coating solution was coated on wood free paper by means of a wire bar and dried at 50° C. to give a reflection density of 1.0 at red-colored portions. Thus, the thermographic material of the invention was obtained.

Example 2

The thermographic material of the invention was prepared in the same manner as in Example 1, except that benzoin isobutyl used in Capsule Solution A was replaced with an equimolecular amount of ethylanthraquinone (absorption maximum wavelength in an ethyl acetate solution: 325 nm).

Example 3

The thermographic material of the invention was prepared in the same manner as in Example 1, except that benzoin isobutyl used in Capsule Solution A was replaced with an equimolecular amount of 4-(4-chlorophenylthio)-2,5-dibutoxybenzenediazonium hexafluorophosphate (absorption maximum wavelength in an ethyl acetate solution: 393 nm)

Example 4

The thermographic material of the invention was prepared in the same manner as in Example 1, except that Dye A-1 used in Capsule Solution A was replaced with an equimolecular amount of Dye B-1 (molar extinction coefficient: about 60,000) and the coating solution was coated to give a reflection density of 1.0 at green-colored portions.

Example 5

The thermographic material of the invention was prepared in the same manner as in Example 1, except that Dye A-1 used in Capsule Solution A was replaced with an equimolecular amount of Dye C-1 (molar extinction coefficient: about 16,000) and the coating solution was coated to give a reflection density of 1.0 at blue-colored portions.

Example 6

The thermographic material of the invention was prepared in the same manner as in Example 1, except that triphenylguanidine used in Anti-decolorizing Agent Solid Dispersion was replaced with an equimolecular amount of N-dodecylpiperazine.

Example 7

(Preparation of Anti-decolorizing Agent Emulsion)

Six parts of dodecylhydroquinone and 1.5 parts of tricresylphosphate were uniformly mixed, 30 parts of a 6% aqueous polyvinyl alcohol solution and 5 parts of a 10% aqueous dodecylbenzene sulfonate solution were added, and emulsified at 40° C. for 10 minutes using a homogenizer and stirred at 40° C. for additional 2 hours. Thus, a dodecylhydroquinone emulsion was obtained.

The thermographic material of the invention was prepared in the same manner as in Example 1, except that the Anti-decolorizing Agent Solid Dispersion of Example 1 was replaced with the above obtained dodecylhydroquinone emulsion in the same amount as the Dispersion of Example 1.

Comparative Example 1

(Preparation of Dye and Photolytic Free Radical Generating Agent Emulsion)

Dye A-1 of 1.5 parts and 1.5 parts of benzoin isobutyl were dissolved in a mixture solvent of 10 parts of ethyl acetate and 10 parts of tricresylphosphate, and 0.5 parts of a 10% aqueous sodium dodecylbenzene sulfonate solution were added. The resulting solution was incorporated into 60 parts of a 6% aqueous polyvinyl alcohol solution and emulsified at 20° C. using a homogenizer to obtain an emulsion containing emulsified particles having an average particle size of 1 μm. To the emulsion 20 parts of water were added, stirred at 40° C. for 3 hours, and cooled to room temperature. Thus, Capsule Solution A was obtained.

(Preparation of Ant-decolorizing Agent Capsule Solution)

Six parts of dodecylhydroquinone, 6 parts of 1-phenyl-1-xylylethane and 8.0 parts of xylylenediisocyanate-trimethylolpropane adduct were uniformly mixed, and 30 parts of a 6% aqueous polyvinyl alcohol solution and 5 parts of a 10% aqueous dodecylbenzene sulfonic acid solution were added. The resulting mixture was emulsified at 20° C. using a homogenizer to obtain an emulsion containing emulsified particles having an average particle size of 1 μm. To the emulsion 20 parts of water were added, stirred at 40° C. for 3 hours, and cooled to room temperature. Thus, Ant-decolorizing Agent Capsule Solution was obtained.

A coating solution was prepared using the above obtained emulsion and capsule solution to contain the dye, photolytic free radical generating agent and anti-decolorizing agent in the same mole as in the Example 7 coating solution. Comparative thermographic material was prepared in the same manner as in Example 7, except that the above obtained coating solution was used.

Comparative Example 2

(Preparation of Capsule Solution C)

Twelve parts of xylylenediisocyanate-trimethylolpropane adduct, 0.41 parts of the following salt of the organic cationic dye with the organic boron compound anion, 0.08 parts of trimethylammonium tetrabutyl borate, 12 parts of methylisobutyl ketone and 15 parts of tricresylphosphate were uniformly mixed. The resulting mixture was incorporated into an aqueous solution consisting of 60 parts of a 8% polyvinyl alcohol aqueous solution, 15 parts of a 1.67% diethylenetriamine aqueous solution and 30 parts of distilled water, and emulsified at 20° C. to obtain an emulsion containing emulsified particles having an average particle size of 1 μm. The resulting emulsion was stirred at 40° C. for additional 3 hours, cooled to room temperature, and filtered. Thus, Capsule Solution C was obtained.

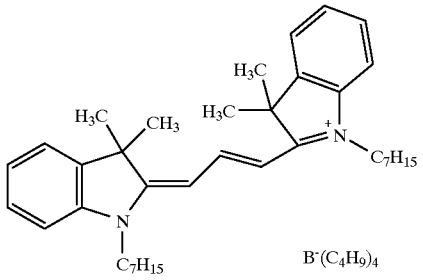

(Preparation of Fixing Agent Dispersion)

Thirty parts of benzyl 4-hydroxybenzoate were mixed with 150 parts of a 4% aqueous polyvinyl alcohol solution and dispersed using a Dyno Mill to obtain Fixing Agent Dispersion containing solid dispersion particles having an average particle size of 3 μm.

(Preparation of Coating Solution)

The Capsule Solution C and Fixing Agent Dispersion prepared above were mixed in a weight ratio of 1:1 to obtain a coating solution.

The resulting coating solution was coated on wood free paper by means of a wire bar and dried at 50° C. to give a reflection density of 1.0 at green-colored portions. Thus, Comparative thermographic material was obtained.

(Color Development/Image Storage Stability Test)

The thermographic material obtained in Examples 1 through 7 and Comparative Example 1 were heated at 120° C. for 5 seconds (0.5 kg/m$^2$) using a heat tester (produced by Toyo Seiki Co.) and entirely exposed for 30 seconds using a high-pressure mercury lamp. The original dye color was maintained at heated portions and the dye color was decolored at non-heated portions. The thermographic material obtained in Comparative Example 2 was heated in the same manner as above, and entirely exposed using a fluorescent lamp to form an image. Densities at the image portions and at non-image portions in each of the resulting materials were measured.

Further, the resulting materials obtained above were exposed for 3 days using a xenon lamp, and densities of the image portions were measured. The density after the 3 day exposure was compared with that before the exposure, and the dye remaining ratio was computed. The results are shown in Table 1.

TABLE 1

| | Color | Density at Image Portions | Density at Non-image Portions | Dye Remaining Ratio (%) |
|---|---|---|---|---|
| Example 1 | Cyan | 0.97 | 0.05 | 94 |
| Example 2 | Cyan | 0.94 | 0.07 | 93 |
| Example 3 | Cyan | 0.98 | 0.09 | 95 |
| Example 4 | Magenta | 0.96 | 0.08 | 90 |
| Example 5 | Yellow | 0.95 | 0.09 | 91 |
| Example 6 | Cyan | 0.98 | 0.06 | 96 |
| Example 7 | Cyan | 0.93 | 0.07 | 90 |
| Comparative Example 1 | Cyan | 0.86 | 0.10 | 85 |
| Comparative Example 2 | Magenta | 0.85 | 0.13 | 65 |

The thermographic materials of the invention obtained in Examples 1 through 7 were printed while heated and exposed. The recording image portions and the non-image portions were repeatedly printed while heated, and repeatedly exposed, respectively. The results exhibited no significant change.

The thermographic materials of the invention obtained in Examples 1 through 7 were stored for 3 days under high temperature (45° C., 20% RH), and then tested in the same manner as above. The densities at the image portions and at non-image portions did not greatly change compared with those before the 3 day storage.

What is claimed is:

1. A thermographic material comprising a support and, provided thereon, a recording layer containing a photolytic free radical generating agent capable of providing a free radical on absorption of light, a dye decolored by the free radical, and an anti-decolorizing agent, the photolytic free radical generating agent and dye being contained in a microcapsule in the recording layer, said photolytic free radical generating agent and said dye being different from each other, and the anti-decolorizing agent being present outside the microcapsule in the recording layer, wherein an image is formed by imagewise heating the thermographic material to mix the anti-decolorizing agent with the photolytic free radical generating agent and the dye to form a latent image, and then exposing the heated material to light which the photolytic free radical generating agent absorbs, so that the dye at the latent image portions is not decolored, and the dye at portions other than the latent image portions is decolored.

2. The thermographic material of claim 1, wherein the dye is an azomethine dye.

3. The thermographic material of claim 1, wherein the photolytic free radical generating agent has an absorption maximum in the wavelength range of 250 to 450 nm.

4. The thermographic material of claim 1, wherein the photolytic free radical generating agent is a carbonyl compound or a diazonium compound.

5. The thermographic material of claim 1, wherein the anti-decolorizing agent is guanidines or amines.

6. The thermographic material of claim 1, wherein the recording layer contains the photolytic free radical generating agent in an amount of $5\times10^{-5}$ to $2\times10^{-2}$ mol/m$^2$, the dye in an amount of $5\times10^{-5}$ to $2\times10^{-2}$ mol/m$^2$, and the anti-decolorizing agent in an amount of $5\times10^{-5}$ to $2\times10^{-2}$ mol/m$^2$.

7. The thermographic material of claim 1, wherein the size of the microcapsule is 0.1 to 20 μm.

8. The thermographic material of claim 1, wherein a material constituting walls of the microcapsule is such a material that the walls prevent the agent and dye within the microcapsule from contacting the decolorizing agent outside the microcapsule at an ordinary temperature, and penetration through the walls takes place to mix the dye with the decolorizing agent, when the walls are heated to at least the glass transition temperature of the material.

9. A recording method of forming an image, the method comprising the steps of:

imagewise heating a thermographic material, which comprises a support and provided thereon, a recording layer containing a photolytic free radical generating agent capable of providing a free-radical on absorption of light, a dye decolored by the free radical, and an anti-decolorizing agent, the photolytic free radical generating agent and dye being contained in a microcapsule in the recording layer, and the anti-decolorizing agent being present outside the microcapsule in the recording layer, to mix the anti-decolorizing agent with the photolytic free radical generating agent and the dye to form a latent image; and exposing the heated thermographic material to light, which the photolytic free radical generating agent absorbs, so that the dye at the latent image portions is not decolored and the dye at portions other than the latent image portions is decolored.

10. The thermographic material of claim 1 wherein said dye is neutral and has no ionic charge.

11. A thermographic material comprising a support and, provided thereon, a recording layer containing a photolytic free radical generating agent capable of providing a free radical on absorption of light, an azomethine dye decolored by the free radical, and an anti-decolorizing agent, the photolytic free radical generating agent and dye being contained in a microcapsule in the recording layer, and the anti-decolorizing agent being present outside the microcapsule in the recording layer, wherein an image is formed by imagewise heating the thermographic material to mix the anti-decolorizing agent with the photolytic free radical generating agent and the dye to form a latent image, and then exposing the heated material to light which the photolytic free radical generating agent absorbs, so that the dye at the latent image portions is not decolored, and the dye at portions other than the latent image portions is decolored.

12. A thermographic material comprising a support and, provided thereon, a recording layer containing a photolytic free radical generating agent capable of providing a free radical on absorption of light, said generating agent being a carbonyl compound or a diazonium compound, a dye decolored by the free radical, and an anti-decolorizing agent, the photolytic free radical generating agent and dye being contained in a microcapsule in the recording layer, and the anti-decolorizing agent being present outside the microcapsule in the recording layer, wherein an image is formed by imagewise heating the thermographic material to mix the anti-decolorizing agent with the photolytic free radical generating agent and the dye to form a latent image, and then exposing the heated material to light which the photolytic free radical generating agent absorbs, so that the dye at the latent image portions is not decolored, and the dye at portions other than the latent image portions is decolored.

13. A thermographic material comprising a support and, provided thereon, a recording layer containing a photolytic free radical generating agent capable of providing a free radical on absorption of light, a dye decolored by the free radical, and a guanidine or amine anti-decolorizing agent, the photolytic free radical generating agent and dye being contained in a microcapsule in the recording layer, and the anti-decolorizing agent being present outside the microcapsule in the recording layer, wherein an image is formed by imagewise heating the thermographic material to mix the anti-decolorizing agent with the photolytic free radical generating agent and the dye to form a latent image, and then exposing the heated material to light which the photolytic free radical generating agent absorbs, so that the dye at the latent image portions is not decolored, and the dye at portions other than the latent image portions is decolored.

* * * * *